US006780302B2

(12) United States Patent
Forand

(10) Patent No.: US 6,780,302 B2
(45) Date of Patent: Aug. 24, 2004

(54) PROCESS FOR ELECTROCHEMICAL TREATMENT OF A CONTINUOUS WEB

(76) Inventor: James L. Forand, 4450 Phillip St., Whitehall, PA (US) 18052-1518

( * ) Notice: Subject to any disclaimer, the term of this patent is extended or adjusted under 35 U.S.C. 154(b) by 354 days.

(21) Appl. No.: 09/961,593

(22) Filed: Aug. 20, 2001

(65) Prior Publication Data

US 2003/0034252 A1 Feb. 20, 2003

Related U.S. Application Data

(62) Division of application No. 09/465,260, filed on Dec. 18, 1999, now Pat. No. 6,322,673.

(51) Int. Cl.[7] ..... C25D 7/06; C25D 5/08; C25D 21/10; C25D 11/00

(52) U.S. Cl. ..... 205/138; 205/133; 205/148; 205/152; 205/333

(58) Field of Search ..... 205/138, 117, 205/152, 148, 133, 333

(56) References Cited

U.S. PATENT DOCUMENTS

| | | | | |
|---|---|---|---|---|
| 3,619,383 A | | 11/1971 | Eisner | 204/35 R |
| 3,619,384 A | | 11/1971 | Eisner | 204/35 R |
| 3,619,386 A | | 11/1971 | Eisner | 204/35 R |
| 4,210,497 A | | 7/1980 | Loqvist et al. | 204/26 |
| 4,828,653 A | | 5/1989 | Traini et al. | 204/23 |
| 5,300,165 A | | 4/1994 | Sugikawa | 156/150 |
| 5,476,578 A | | 12/1995 | Forand | 204/207 |
| 5,938,899 A | | 8/1999 | Forand | 204/259 |
| 6,238,529 B1 | * | 5/2001 | Geissler et al. | 204/202 |

OTHER PUBLICATIONS

GAR–DUR® UHMW Technical Data Sheet, Garland Manufacturing Company (Not dated).

* cited by examiner

*Primary Examiner*—Edna Wong
(74) *Attorney, Agent, or Firm*—Harold I. Masteller, Jr.

(57) ABSTRACT

A process for use in a continuous electrochemical treating line for electrochemically treating at least one surface of a continuous web moving through an electrolyte solution contained within a tank. The process includes the steps of providing at least one electrode extending across the surface of the continuous web in combination with at least one rigid non-flexible and non-conductive bumper devices also extending across the continuous web surface. The bumper devices include a contact surface positioned against the continuous web surface at spaced apart locations that prevent the continuous web from moving outside a pass-line through the electrolyte solution and arcing against the electrode. The bumper devices may comprise either a bumper strip or a conduit.

31 Claims, 8 Drawing Sheets

10a
10b
10c
11
12
13a
13b
13y
13z
14
15
16
17
18
19
20
21a
21b
22
23
24
25
34
35
L
D
θ

50A 51
52
38
53
55
53
55
56a
56b
56z
55
34
58a
58b
58c
58d
58y
58z
13a
59
59
59
10a, 10b, 10c
13b
59
56a
56b
59
56z
13c
59
13cd
59
13ce
61
54
10a, 10b, 10c
13cf
59
59
10a, 10b, 10c
13cx
60
13cy
59
13cz
60
61
61
59
14, 16
60
59
59
53
53
53

50B
52
51
14
70
53
53
38
34
60
55
55
56b
56c
61
56e
56y
65
56d
56a
55
56z
13a
10a, 10b, 10c
13b
13c
54
13d
13e
13f
13g
13h
13z
14, 16
59
60
61
59z
58a
59b
58c
59d
58y
59a
59c
59y
58b
58d
53
53
53
58z
14

73
34
58b
59b
72
67
66
D
81
80
69a
71
65
75a
69b
76
70
75x
69x
76
70
75y
69y
70
76
75z
74
69z
70
68

PROCESS FOR ELECTROCHEMICAL TREATMENT OF A CONTINUOUS WEB

This is a division of application Ser. No. 09/465,260 filed Dec. 18, 1999 now U.S. Pat. No. 6,322,673 B1,

BACKGROUND OF THE INVENTION

This invention is related to apparatus and a process for supporting and maintaining a continuous web product in a pass-line position through an electrolyte solution in a continuous electrochemical treatment operation, and in particular, it is directed to the use of rigid, non-conductive, non-polar bumper devices having a slick surface that contacts and maintains the continuous web in the pass-line position. The apparatus and process improves electrochemical treatment rates, prevents arcing between the continuous web and electrodes positioned adjacent the web pass-line, and produces a continuous electrochemically treated web product having minimal surface defects.

It is recognized, for example in applicant's prior U.S. Pat. No. 5,476,578, incorporated herein in its entirety by reference, that plating efficiency can be increased by using resilient wiper blades that contact and remove bubbles of hydrogen (surface film) from the strip during an electroplating operation. Surface film buildup depletes available electrolyte at the cathodic work surface and reduces plating rates. The resilient wiper blades sweep away the surface film, (depleted electrolyte) thereby creating a hydraulic inflow of fresh electrolyte at the work surface or interface. In the preferred embodiment, the U.S. Pat. No. 5,476,578 patent teaches using a resilient wiper blade arrangement that allows "ready escape of the depleted electrolyte and replacement with fresh electrolyte."

In U.S. Pat. No. 5,938,899, also incorporated herein in its entirety by reference, applicant teaches that during electroplating the composite barrier layer comprises a combination of: 1) hydrogen bubbles, 2) a micro-ion depletion layer, and 3) a thermal barrier. This composite barrier prevents, or at least reduces, a rapid exchange of depleted electrolyte with fresh electrolyte at the substrate interface being plated. If the electroplating process fails to provide a continuous supply of fresh electrolyte at the plating interface, the plating rate speed will fall off. Therefore, it is necessary for an efficient plating operation to include means for removing the composite barrier layer and for delivering fresh electrolyte to the plating interface.

With the understanding that the above prior patents demonstrate an improvement in the art, continuous use in production along with careful research has revealed some inherent problems in earlier teaching. For example, it has been found that resilient wiper blades can effectively remove the composite barrier layer from a plating interface. However, because such wiper blades are resilient, their flexibility, creates problems for operators when the gauge or weight of the web material is increased, and in particular, when such resilient wiper blades are used in a horizontal line, the heavier web material causes unwanted flexing in the wiper blades. In such instances, the wiper blades can collapse under the increased load and arc against the plating electrodes positioned adjacent the continuous web pass-line. Such arcing can also occur in a vertical plating operation if extreme web flutter occurs along the pass-line, or if the shape of the web is extraordinarily uneven. In such circumstances, the wavy, vertically moving web, can impact against the resilient wiper blades, cause them to flex or collapse, and arc against the plating electrodes that are vertically positioned along the pass-line.

Production operations have revealed that, in certain instances, dendrites or whiskers can grow on nicked or cut wiper blades and the dendrites can damage and reduce the surface quality of the finished electrochemically treated product. For instance, a metal substrate in sheet or strip form has thin sharp edges that move at very high speeds, about 1,800 feet per minute, through a continuous treatment line, If any web flutter or wobble occurs, the thin sharp edges will cut and nick the wiper blades and bumper devices that are used to wipe and maintain the web in its pass-line position. Such nicks and cuts may attract ions that become nuclei for dendrite or whisker growth in certain combinations of polymer materials submerged in electrolyte baths. As the dendrites enlarge and solidify, their abrasive properties scratch and damage the web surface.

Metal sheet and strip substrates can also have slivers or burrs along the strip edge. Such imperfections also cut and nick wiper blades and bumper devices, even in the absence of any web flutter, creating nuclei for dendrite or "barnacle" growth. Additionally to provide a continuous web, operators weld or join the leading and tailing ends of coiled sheet to provide an uninterrupted web that moves continuously through an electrochemical treatment operation. Such weld joints can also cut and nick wiper blades and bumper devices creating nuclei for dendrite growth.

Research work directed to eliminating dendrite growth has led to the unexpected discovery that if a non-polar material is used to manufacture the bumper devices of the present invention, dendrite growth is eliminated, or at least reduced to a level where it is of little concern. Tests were conducted using various materials to manufacture bumper devices before it was discovered that a non-polar, ultra high molecular weight polymer material, with a slick outer surface having a dry relative coefficient of sliding friction to rolled steel of about 0.30 or lower, overcomes all of the aforementioned problems. One such exemplary ultra high molecular weight polymer material suitable for making the bumper devices of the present invention is GAR-DUR®, manufactured by Garland Manufacturing Company, Saco, Me. Referring to the GAR-DUR® UHMW Technical Data Sheet, incorporated herein by reference.

Earlier patents teach using rigid plastic materials to prevent substrates from arcing against plating electrodes. For example, U.S. Pat. No. 4,828,653 discloses using a plurality of parallel rods (4) of a suitable insulating material. However, U.S. Pat. No. 4,828,653 fails to recognize the dendrite problem and completely fails to teach or suggest a solution for reducing or eliminating the dendrites that will form on the rods (4) if the invention is used in production.

U.S. Pat. Nos. 3,619,383, 3,619,384, 3,619,386, and 3,734,838, to Eisner disclose using non-conducting, bumper like devices between a substrate and electrode in a plating line. However, Eisner actually teaches away from the present invention by encouraging operators to scratch the surface of the plated substrate. In each instance, Eisner teaches impregnating his non-conducting bumper like devices with an abrasive grit to facilitate scratching the plated surface as it moves across his bumper.

Additionally, prior teaching fails to provide a positive or pressurized inflow of fresh electrolyte at the plating interface. As heretofore mentioned, the resilient wiper blades sweep away depleted electrolyte creating a natural forced hydraulic inflow of fresh electrolyte at the work surface. However, it must be remembered that if the electroplating process fails to provide a continuous, sufficient supply of fresh electrolyte at the plating interface, the plating rate speed will fall off. Therefore, it is very desirous to provide an inflow of fresh electrolyte to the electrochemical treatment interface at a positive pressure, the pressurized inflow being at a volume that will prevent a slowdown in treatment rate speed.

SUMMARY OF THE INVENTION

It is therefore the primary object of the disclosed invention to provide electrochemical treatment apparatus having rigid non-conductive bumper devices that maintain a continuous web in a pass-line through an electrolyte solution.

It is a further object of this invention to provide rigid non-conductive bumper that resists flexing under a load or web weight.

It is still a further object of this invention to provide rigid non-conductive bumper devices having a slick surface that will not damage the finish surface of an electrochemical treated substrate.

It is another object of this invention to provide non-polar bumper devices that are resistant to dendrite growth.

It is still another object of this invention to provide rigid non-conductive bumper devices having means to deliver a pressurized flow of fresh electrolyte to an electrochemical treatment interface.

Other objects and advantages of the present invention will become apparent from the following detailed description thereof.

In satisfaction of the foregoing objects and advantages, the present invention provides apparatus for use in a continuous electrochemical treating line and a method for electrochemically treating at least one surface of a continuous web moving through an electrolyte solution contained within a tank. The apparatus includes at least one electrode extending across the surface of the continuous web in combination with at least two rigid, non-conductive, and non-polar bumper devices also extending beyond the continuous web surface. The bumper devices include a slick contact surface positioned against the continuous web surface at spaced apart locations that prevent the continuous web from moving outside a fixed pass-line through the electrolyte solution and also prevent arcing against the electrode. The bumper devices may comprise either a bumper strip or a conduit.

DETAILED DESCRIPTION OF THE PREFERRED EMBODIMENT

Figures 1, 2, 3, 4, 5, 6:
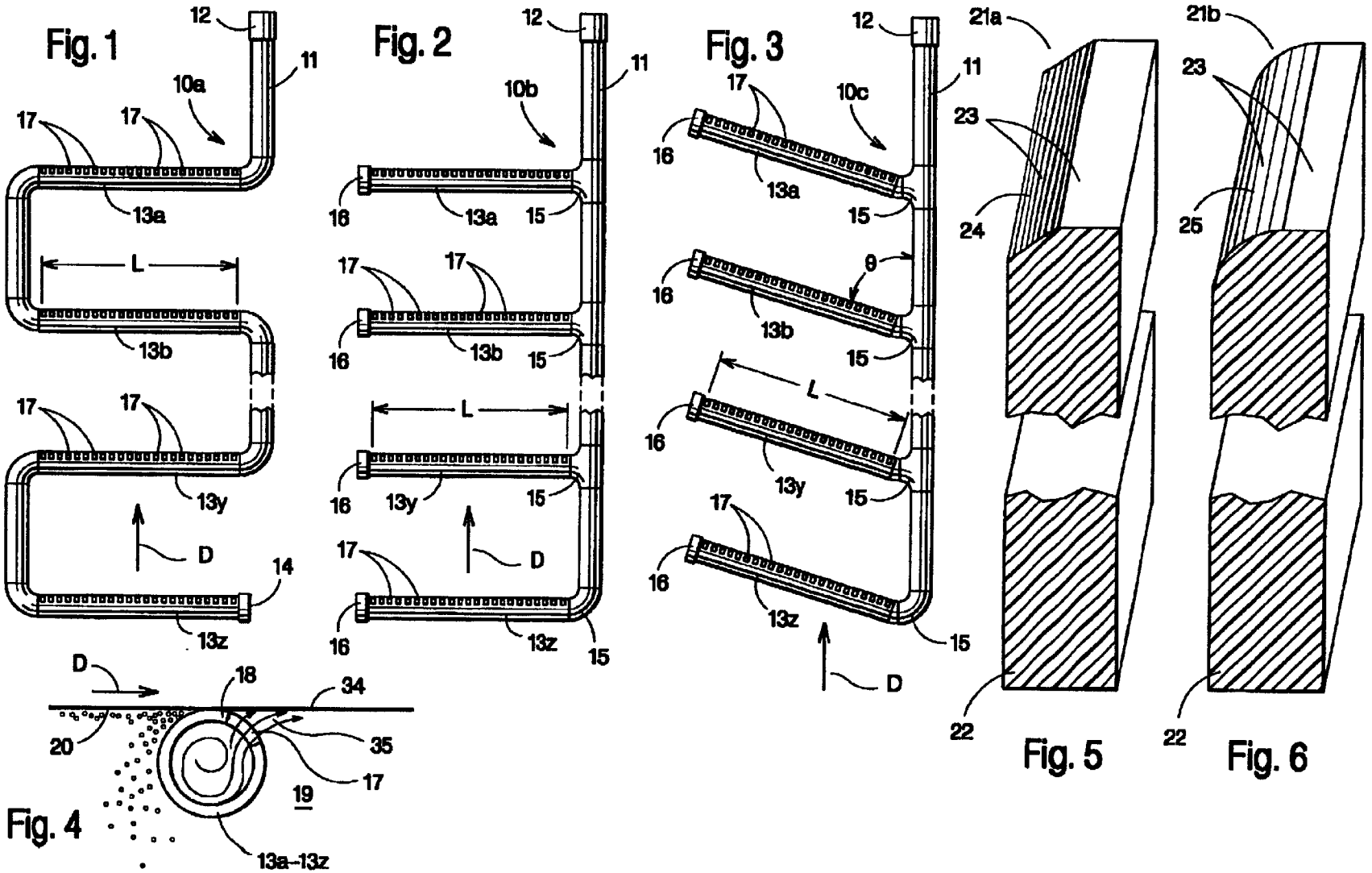
FIG. 1. is an elevation view showing a first embodiment of a conduit bumper device.
FIG. 2. is an elevation view showing a second embodiment of a conduit bumper device.
FIG. 3. is an elevation view showing a third embodiment of a conduit bumper device.
FIG. 4. is a cross-section view taken through a conduit bumper device.
FIG. 5. is an isometric view showing a first bumper strip embodiment.
FIG. 6. is an isometric view showing a second bumper strip embodiment.

Referring to FIGS. 1–3, the drawings show different exemplary embodiments of conduit bumper devices 10*a*, 10*b*, and 10*c* of the present invention. Each conduit embodiment includes a feed side 11 having an attachment end 12 for connection to a supply of fresh electrolyte solution (not shown), and a plurality of spaced apart conduit portions 13*a*–13*z*, each conduit portion having a slick outside surface. FIG. 1 shows a continuous serpentine shaped conduit bumper 10*a* having a feed side 11, an attachment end 12, a capped end 14, and a plurality of conduit portions 13*a*–13*z* spaced apart along the length of the continuous serpentine shaped conduit between the connection end and the capped end. The conduit portions are aligned in a non-parallel direction to feed side 11, for example perpendicular, and in the exemplary embodiment shown in FIG. 1, the conduit portions 13*a*–13*z* are shown in a parallel spaced apart relationship. However, it should be understood that the conduit portions may be aligned in a non-parallel spaced apart relationship without departing from the scope of this invention.

Referring now to FIG. 2, conduit bumper 10*b* includes a feed side 11, an attachment end 12 and a plurality of spaced apart conduit portions 13*a*–13*z* that branch outward from feed side 11. The spaced apart conduit portions are aligned perpendicular to feed side 11 and each conduit portion includes a connection end 15 communicating with feed side 11, and a capped end 16 opposite the connection end.

FIG. 3 shows an alternate conduit bumper embodiment 10*c* similar to FIG. 2. However, in this instance, the spaced apart conduit portions 13*a*–13*z* branch outward at an angle θ from feed side 11, and each angled conduit portion includes a connection end 15 and a capped end 16.

As more clearly shown in FIGS. 1–4, each conduit portion 13*a*–13*z* includes a plurality of spaced apart apertures 17 that extend through a wall 18 of the conduit portion along a length "L." Apertures 17 are located on the downstream side 19 of the conduit portions with respect to the direction of continuous web travel "D" when the conduit portions 13*a*–13*z* are placed adjacent a continuous moving web 34 in an electrochemical treatment operation. Additionally apertures 17 extend through conduit wall 18 at a location that will position the spaced apart apertures immediately adjacent the work surface or treatment interface 20 along the continuous web 34 being electrochemically treated. Such close proximity to the web surface provides means for delivering a flow of fresh electrolyte 35 from the supply end of the feed line 11 to the treatment interface 20. Apertures 17 may comprise any convenient or suitable size or shape, for example they may be round, rectangular, triangular, or a singular elongated slot that extends along the length "L" of the conduit portions 13*a*–13*z*. Additionally, although the conduit portion shown in FIG. 4 shows a round tube section, the conduit portion may comprise a rectangular or other suitable cross-section shape without departing from the scope of this invention.

Referring now to FIG. 5, the drawings shows a cross-section taken through an elongated bumper strip 21*a*. Bumper strip 21*a* is manufactured having a length equal to or greater than the width of a continuous web that will be treated in a preselected electrochemical treatment line for which the bumper strip is designed. The bumper strip includes a connection end 22 having any suitable means for attachment to an electrode in electrochemical treatment operation, for example a bolt, clamp or socket arrangement, and a slick contact end surface 23 shaped to receive, support, and maintain a continuous web moving at high speed in a pass-line position through an electrochemical treatment operation. The slick contact end surface 23 includes a chamfer 24 along one of the edges, the chamfer intended to receive incoming high-speed continuous web. Chamfer 24 provides a sliding surface that smoothly receives incoming web irregularities such as web weld joints or defects that may appear along the continuous web.

FIG. 6, illustrates a second elongated bumper strip embodiment 21*b*. Bumper strip 21*b* is also manufactured having a length equal to or greater than the width of a continuous web being treated in a preselected electrochemical treatment line. The bumper strip includes a connection end 22 having any suitable means for attachment to an electrode in electrochemical treatment operation, for example a bolt, clamp or socket arrangement, and a slick contact end surface 23 shaped to receive, support, and maintain a continuous web moving at high speed in a pass-line position through an electrochemical treatment operation. The slick contact end surface 23 includes a rounded chamfer 25 along one of the edges defining the slick contact end surface 23, the chamfer intended to receive incoming high-speed continuous web. The rounded chamfer 25 provides means for web weld joints, or any other irregularity that may appear along the continuous web, to smoothly travel or pass over the slick contact end surface 23 of the bumper strip.

It is well known within the state-of-the-art that the closer electrodes are positioned with respect to the work interface, the faster the rate of electrochemical treatment. It is also well known that any physical contact with the work interface during treatment, for example, plating, or anodizing may damage the surface of the finish product. Applicant's earlier patents overcome such problems by providing resilient wiper blades that gently touch and yield under strip pressure to prevent marking or damaging the product surface as the resilient wiper blades remove the composite barrier layer from the work interface. However, in some actual production operations, such resilient wiper blades may incur problems. For example, even though the soft touch provided by the resilient wiper blades successfully removes the composite barrier layer in a continuous horizontal plating operation without marring the product surface, as strip gage is increased the heavier strip causes unwanted flexing in the resilient wiper blades and allows the strip product to fall outside its pass-line through the electrolyte solution adjacent the plating electrodes. In such instances the strip product can arc against the electrodes creating various problems for the operators including damaged and lost product. Similarly, sudden jerks or jars caused by welding the lead end of a new coil of web material to the tail end of a finished coil in a continuous high speed line can generate shock waves or undulations (flutter or wobble) along the continuous web. In both horizontal and vertical electrochemical treatment operations, such flutter can also cause unwanted flexing in the resilient wiper blades and allow the strip product to fall outside its pass-line through the electrolyte solution and arc against the electrodes. Such arcing will also cause product damage.

In an effort to overcome such problems, research was directed to providing a rigid bumper system that will not flex under such loading conditions and continue to maintain a continuous web in its pass-line without marking or damaging the web surface. Various materials were tested to develop the flexible wiper blades disclosed in the earlier work shown in above mentioned patents incorporated herein by reference, and to develop the bumper strips and conduits disclosed in this work. For example, the earlier research work ruled out HYPALON® as a material for manufacturing the bumper devices of the present invention. During earlier research, it was discovered that when immersed in certain electrolyte compositions, HYPALON bumper devices attract ions and form dendrites or barnacles along the bumper surface; the barnacles scratching and damaging the finished surface of the electrochemically treated substrate moving at high speed through the treatment line. Similar tests conducted with bumper devices manufactured from polypropylene materials produced the same dendrite growth results. It was discovered that such dendrite growth is always dependent upon a particular material used to manufacture the bumper device in combination with the electrolyte composition, e.g. the metal being plated. However, tests conducted with bumper devices manufactured from a non-polar material failed to produce any dendrite or barnacle growth irrespective of the electrolyte chemistry.

Therefore, it was discovered that if the bumper devices shown in FIGS. 1–6, or any variation thereof, are manufactured using a non-polar, ultra high molecular weight polymer material, having a slick surface with a dry relative coefficient of sliding friction to rolled steel of about 0.30 or lower, all of the aforementioned problems are overcome. One such exemplary ultra high weight molecular weight material that may be used to manufacture the bumper devices of the present invention is a polymer product manufactured under the name Gar-Dur® by Garland Manufacturing Co. located in Saco, Me. However, it should be understood that any rigid, non-polar, slick surfaced material that will not mar or damage the product surface can be used to manufacture the present bumper devices without departing from the scope of this invention.

Additionally, and of primary importance, it was unexpectedly discovered that when resilient wiper blades are replaced with rigid bumper devices of the present invention in a continuous electrochemical treatment operation, line speed can be increased because the electrochemical reaction occurs at a faster rate. The mechanism for the improved reaction rate is not fully understood, however, production records in actual continuous electroplating operations located in San Paulo, Brazil, where resilient wiper blades were replace with the rigid bumper devices of the present invention, show a 20% or greater improvement in plating rate speed over the plating rate achieved using resilient wiper blades.

Figure 7:
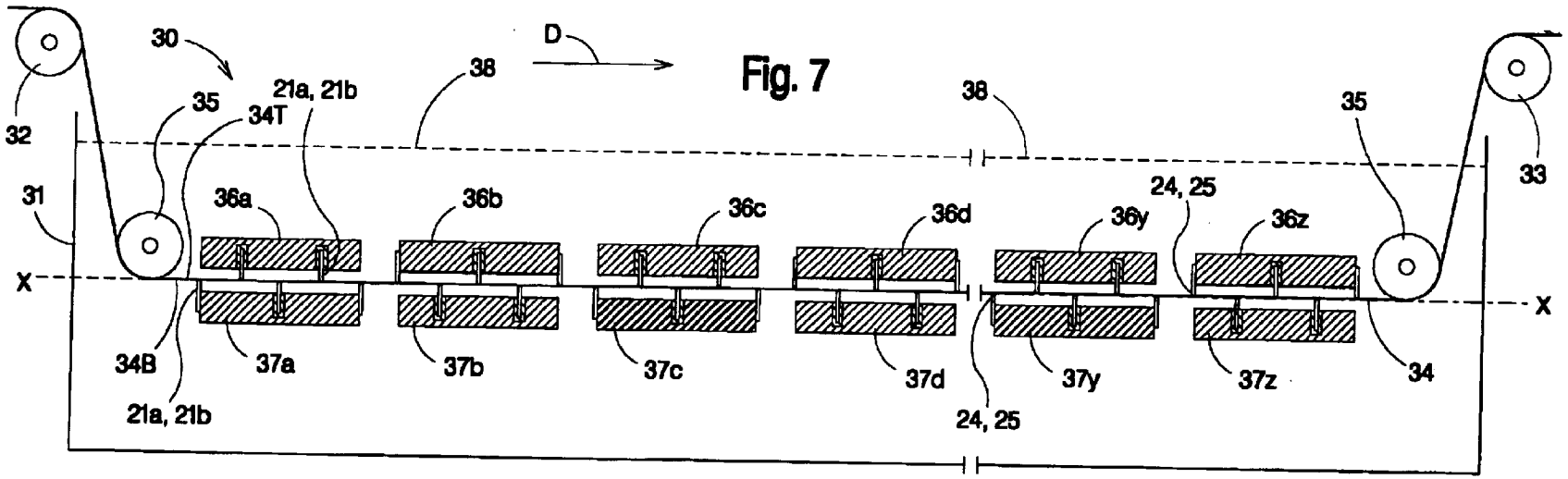
FIG. 7. is a schematic diagram showing a horizontal electrochemical treatment line using bumper strips to maintain a continuous web in a pass-line through an electrolyte solution.

Referring now to FIG. 7 of the drawings, a horizontal, continuous electrochemical treatment system 30 comprising a tank 31 having a feed side roll 32, an exit side roll 33, and sinker rolls 35 for immersing a continuous web product 34 being electrochemically treated in an electrolyte solution 38. Either the feed side roll 32 or the exit side roll 33, or both, may be a contact roll that delivers an electrical charge to the continuous web product 34. A plurality of electrodes 36*a*–36*z* are positioned at spaced apart locations along the top surface 34T of the continuous web, and similarly, a plurality of electrodes 37*a*–37*z* are positioned at spaced apart locations along the bottom surface 34B of the continuous web to electrochemically treat both surfaces of the continuous web 34 as it moves at high speed in a pass-line "X" through the electrolyte solution 38. Pass-line "X" is located between the top and bottom electrodes 36*a*–36*z* and 37*a*–37*z* respectively. Electrodes 36*a*–36*z* and 37*a*–37*z* are positioned closely adjacent their respective web surfaces 34T and 34B to approach the work interface as close as possible without causing arcing between the continuous web and the electrodes. By way of illustration, applicant's two earlier patents, incorporated herein by reference, teach a preferred electrode to web surface distance of between ⅛–⅝ of an inch, shown herein as a treatment distance "TD" in FIG. 9.

Each electrode 36*a*–36*z* and 37*a*–37*z* is shown including at least two elongated bumper strips 21*a* or 21*b* that extend at least across the full width of their respective electrodes. The bumper strips that are positioned along the periphery of the electrodes may be attached to the electrodes using bolts, screws, rivets, or any other suitable fastening means including bonding, without departing from the scope of this invention. Such fastening means are shown as 39 in FIG. 9, and they attach the outer most bumper strips to the periphery of the electrodes, for example electrode 36*a* and electrode 37*a*. The bumper strips that are positioned inboard of the periphery e.g. along the upstream and/or downstream sides of the electrodes, may be attached thereto using any convenient fastener device such as sockets, clamps, or brackets shown as 40 in FIG. 9, without departing from this invention. Referring again to FIG. 7, the outside and inside bumper strips are respectively fastened to the spaced apart electrodes either the fastener or socket arrangements shown in FIG. 9. Additionally, bumper strips 21*a* or 21*b* are positioned along the web surfaces 34T and 34B in a spaced apart arrangement whereby the top and bottom bumper strips are not located directly opposite one another. This prevents binding or pinching the continuous web between the bumper strips. Each bumper strip is aligned to place the chamfer edge 24 or 25 upstream with respect to the direction of web travel "D" to receive the incoming high-speed web. Each bumper strip is manufactured from a rigid, non-polar, ultra high molecular weight polymer material having a slick surface. In the preferred embodiment, the slick surface has a dry relative coefficient of sliding friction to rolled steel of about 0.30, with a preferred surface slickness comprising a dry relative coefficient of sliding friction to rolled steel of about 0.15 or less. The slick surface enables operators to place the contact surfaces 23, shown in FIGS. 5 and 6, against the top and bottom surfaces 34T and 34B of the continuous web, that is moving at high speed through the electrolyte solution, without marring or damaging the web surfaces during the electrochemical treatment process. Additionally, even though the bumper strips 21*a* or 21*b* are shown as straight elongated slat like members, they may be manufactured to include all the shapes and embodiments of the wiper blades disclosed in the prior patents incorporated herein.

Figure 8:
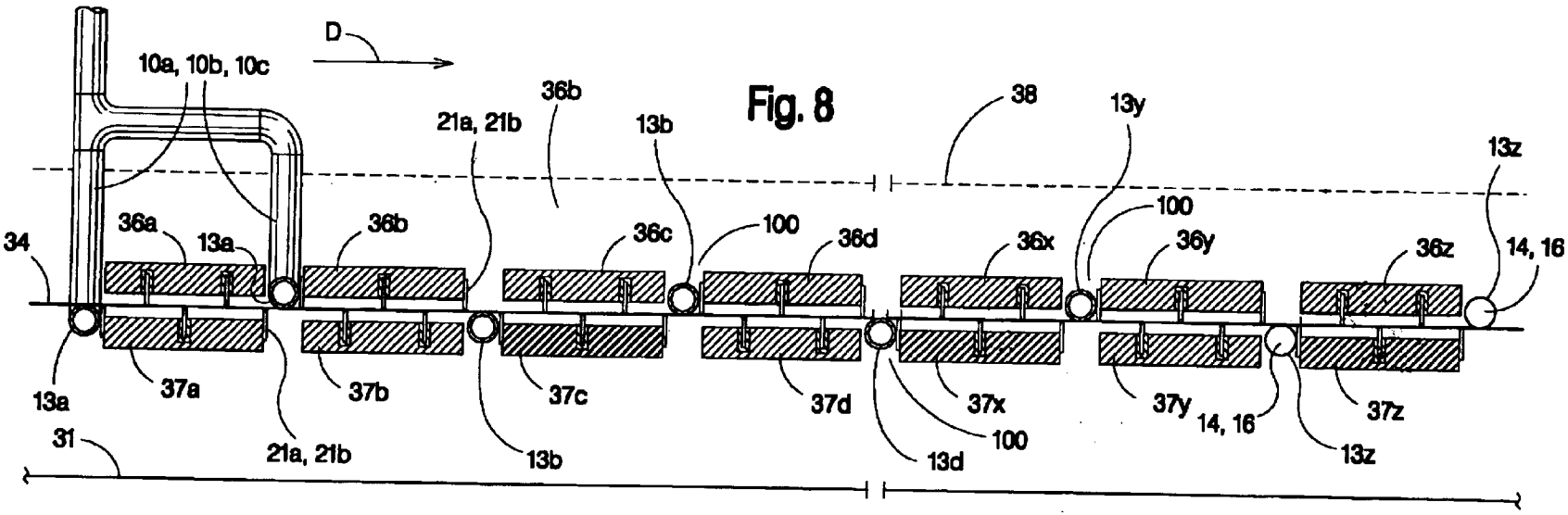
FIG. 8. is a schematic diagram showing a horizontal electrochemical treatment line using bumper strips in combination with conduit bumper devices to maintain a continuous web in a pass-line through an electrolyte solution.

Referring now to FIG. 8, the drawing shows an alternate electrochemical treatment system comprising bumper strips 21*a* or 21*b* in combination with conduits 10*a*, 10*b*, or 10*c* shown in FIGS. 1–3. In this arrangement, bumper strips 21*a* or 21*b* are attached to electrodes 36*a*–36*z* and electrodes 37*a*–37*z* in a manner similar to the one disclosed in FIG. 7. The conduit portions 13*b*–13*y* are positioned within the space 100 provided between the spaced apart electrodes in (FIG. 8), and each conduit portion 13*a*–13*z* is positioned to place its slick outside surface against a corresponding surface, 34T or 34B of the continuous web moving at high speed along its pass-line through the electrolyte solution 38 contained in tank 31.

Figure 9:
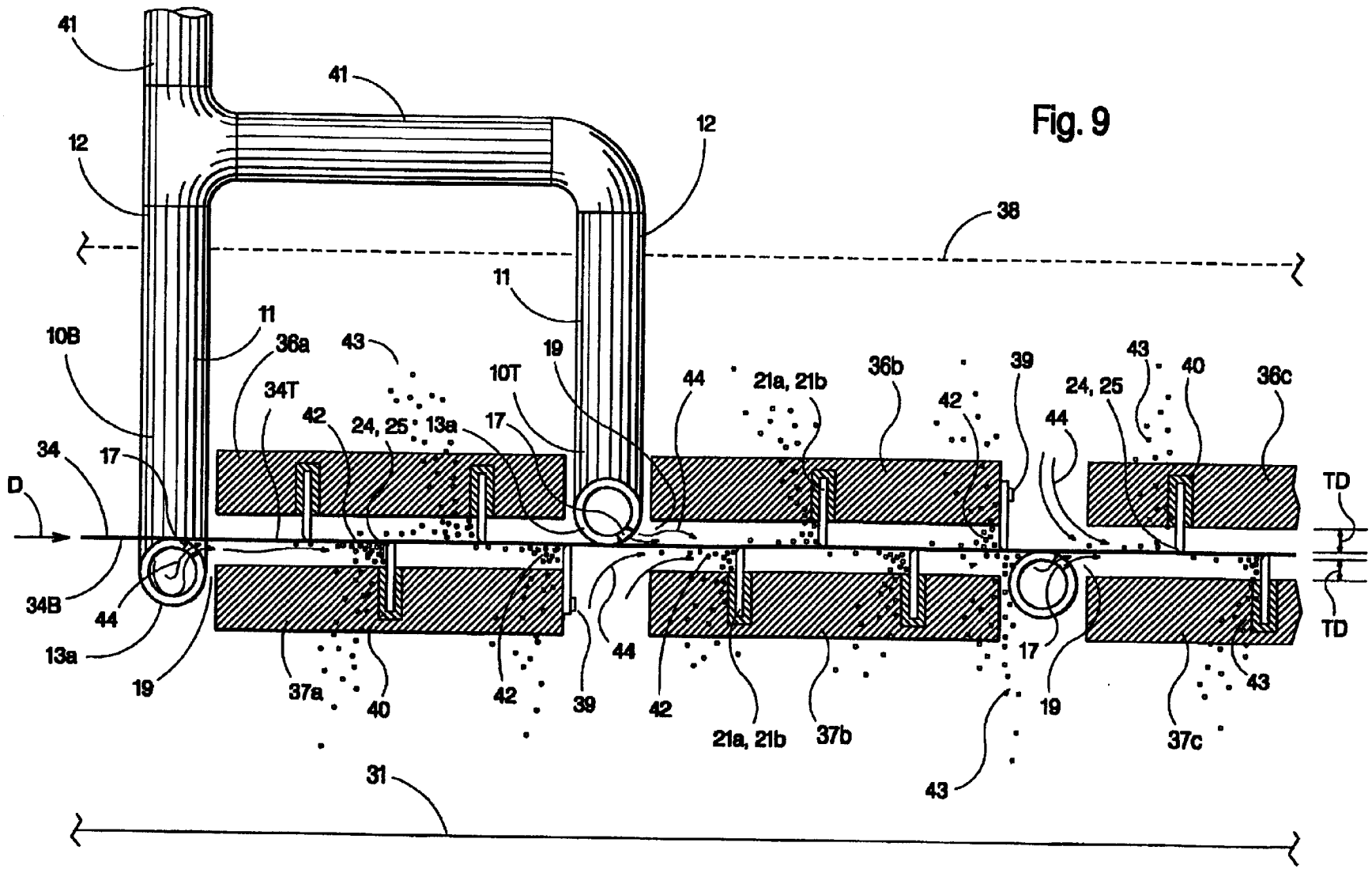
FIG. 9. is an enlarged portion of the schematic diagram shown in FIG. 8.

Referring to FIG. 9, an enlarged portion of the embodiment shown in FIG. 8, a bottom conduit 10B includes a feed side 11 having an attachment end 12 fastened to a supply line 41 attached to a supply of fresh electrolyte (not shown) suitable for use in a specific electrochemical treatment operation. The fresh electrolyte is fed to bottom conduit 10B under a positive pressure that is provided by pumps, gravity, or other means in combination with, or in the absence of, a control valve system (not shown). Similarly, the top conduit bumper 10T includes a feed side 11 having an attachment end 12 fastened to the supply line 41. As more clearly shown in this enlarged view, the outboard bumper strips 21*a* or 21*b* are fastened to the electrodes using fasteners 39 such as bolts or screws, and the inboard bumper strips 21*a* or 21*b* are attached to the electrodes using a socket arrangement 40. Again, such fastening devices are only exemplary and any fastening arrangement may be used to attach bumper strips 21*a* or 21*b* to the electrodes 36*a*–36*z* and 37*a*–37*z*.

In the FIGS. 8–9 embodiment, each bumper strip is positioned to extend across the width of the continuous web 34 with the slick contact surface 23 (FIGS. 5 and 6) of each bumper strip 21*a* or 21*b* contacting a respective treatment interface portion that corresponds with web surface 34T or 34B and with the chamfer 24 or 25 located on the upstream side of the strip 21*a* or 21*b*. Each conduit portion 13*a*–13*z* is positioned to extend across the width of the continuous web 34 with its apertures 17 located immediately adjacent its respective treatment along web surface 34T or 34B. The apertures are located on the downstream side 19 of the conduit portions with respect to the direction of web travel "D," and the slick outside surface of wall 18 is positioned against each respective treatment interface portion along web surface 34T or 34B.

During an electrochemical treatment process, as the continuous web 34 moves at high speed through the electrolyte solution between electrodes 36*a*–36*z* and 37*a*–37*z*, the composite barrier, represented by the bubbles 42, forms along the treatment interface. As heretofore mentioned, the composite barrier comprises the combination of hydrogen bubbles, a micro-ion depletion layer, and a thermal barrier. The rigid ultra high molecular weight bumper devices 21*a* or 21*b* and 13*a*–13*z* that are positioned against the continuous web surface 34T or 34B dislodge the composite barrier from the treatment interface, as shown at 43, thereby creating an inflow of fresh electrolyte 44 to the treatment interface. Additionally the conduit portions 13*a*–13*z* of the top and bottom conduit bumpers 10T and 10B provide a continuous, pressurized flow of fresh electrolyte to the treatment interface to supplement the hydraulic electrolyte inflow created by the bumper devices 21*a* or 21*b* and 13*a*–13*z*.

Figure 10:
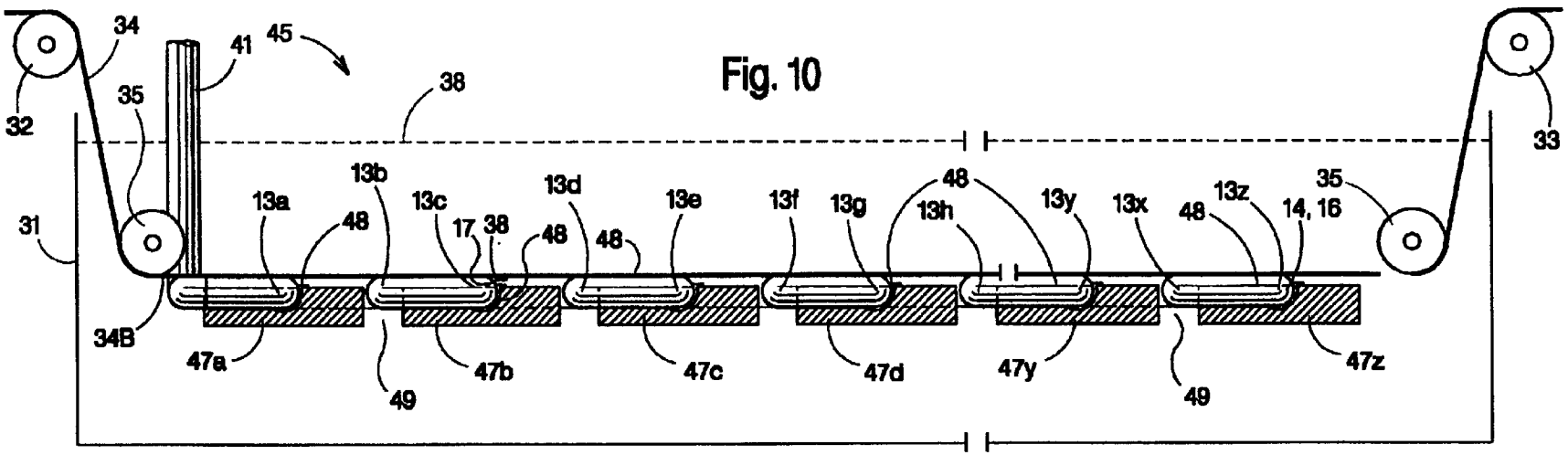
FIG. 10. is a schematic diagram showing a horizontal electrochemical treatment line for treating one side of a continuous web, the treatment line using conduit bumper devices for maintaining the continuous web in a pass-line through an electrolytic solution.

Referring now to FIG. 10 showing a system 45 for electrochemically treating one side of a continuous web 34, the system comprises an electrolyte solution 38 contained in tank 31 having rolls 35 to immerse the web in the electrolyte. Similar to FIG. 7, either the feed side roll 32 or the exit side roll 33, or both, may be a contact roll that delivers an electrical charge to the continuous web product 34. A plurality of bottom electrodes 47*a*–47*z* are positioned at spaced apart locations along the bottom surface 34B of the continuous web. Each electrode includes a notch extending across its surface adjacent web 34 and the notch is shaped to receive brackets 48. Brackets 48 fasten conduit portions selected from the group 13*a*–13*z* to the electrode surface at a position whereby a portion of the outside wall 18 is in contact with the treatment interface along web surface 34B. As heretofore described, apertures 17 are located adjacent the treatment interface and on the downstream side of the conduit portions and fresh electrolyte 38 is delivered to the bottom conduit bumper 10B through supply line 41. As clearly shown in the drawing figure, certain selected conduit portions extend across the electrodes 47*a*–47*z* while other selected conduit portions of the group 13*a*–13*z* extend across the web within the openings 49 provided between the spaced apart electrodes. Although this arrangement shows an alternating one to one pattern with respect to conduit portions within the openings 49 and conduit portions fasten to the electrodes, any arrangement may be used, including two or more conduit portions attached to a single electrode, to satisfy electrolyte demand for a particular treatment line.

Figure 11:
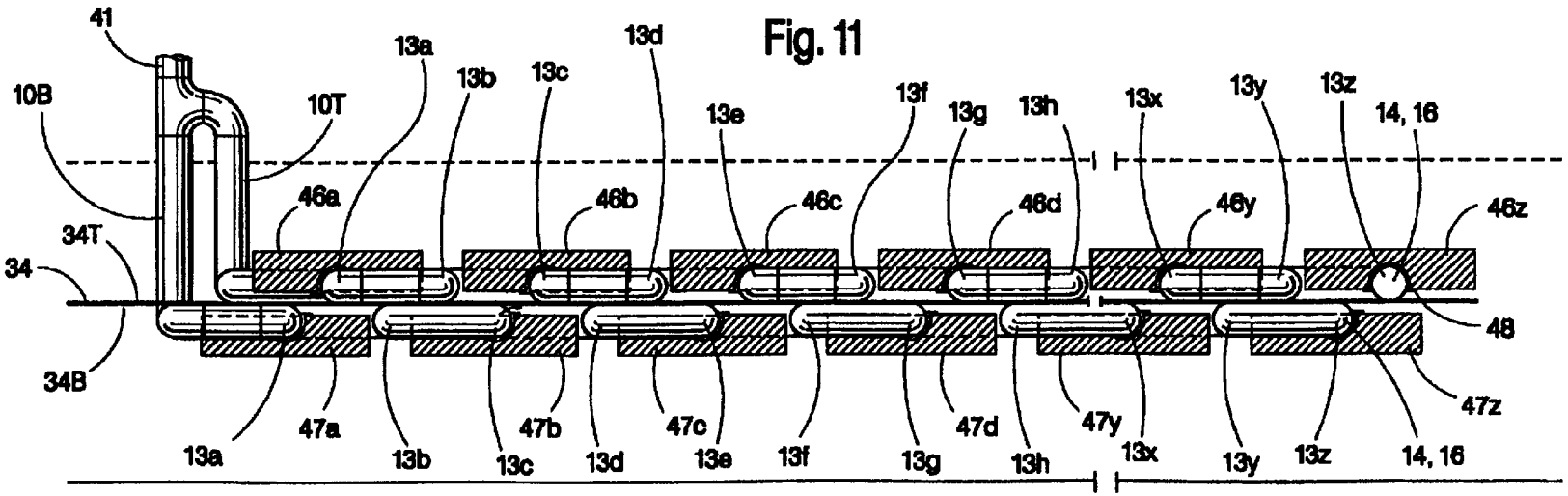
FIG. 11. is a schematic diagram showing a horizontal electrochemical treatment line for treating two sides of a continuous web, the treatment line using conduit bumper devices for maintaining the continuous web in a pass-line through an electrolytic solution.

FIG. 11 is an alternate embodiment of the electrochemical treatment system 45 shown in FIG. 10. However, in this instance, the system includes a top conduit arrangement 10T in combination with the bottom conduit arrangement 10B. Conduit 10T includes a plurality of conduit portions 13*a*–13*z* positioned within the openings and fastened to extend across the spaced apart top electrodes 46*a*–46*z*. The spaced apart top electrodes 46*a*–46*z* include the notches and brackets 59 as described in FIG. 10 and conduit 10T is attached to the fresh electrolyte supply through line 41. In similar manner, conduit 10B includes a plurality of conduit portions 13*a*–13*z* positioned within the openings and fastened to extend across the spaced apart top electrodes 47*a*–47*z*. The spaced apart top electrodes 47*a*–47*z* include the notches and brackets 59 and conduit 10B is attached to the fresh electrolyte supply through line 41. As stated before, the spaced apart arrangement of the conduit portions can be changed to meet the needs of a particular electrochemical treatment operation.

Figure 12:
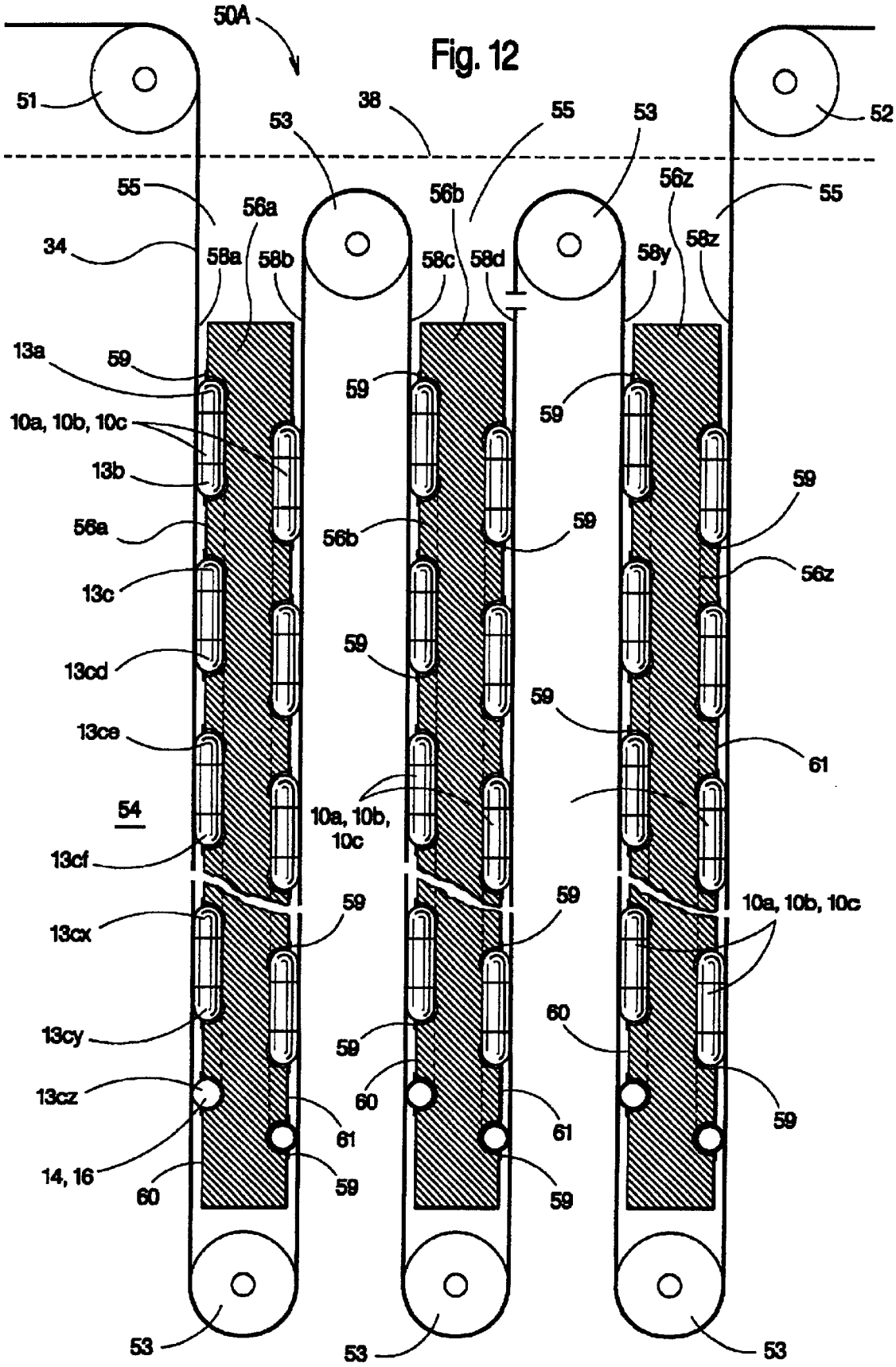
FIG. 12. is a schematic diagram showing a vertical electrochemical treatment line for treating one side of a continuous web, the treatment line using conduit bumper devices for maintaining the continuous web in a pass-line through an electrolytic solution.

Referring to FIG. 12, a vertical electrochemical treatment system 50A for treating a single side of a continuous web 34 is shown comprising an entry roll 51, exit roll 52, and looper rolls 53 immersed in electrolyte solution 38. Again, either the entry roll 51 or the exit roll 52, or both, may be a contact roll that delivers an electrical charge to the continuous web substrate 34. The continuous web 34 runs through the electrolyte solution in a series of up and down passes as it follows the looper roll arrangement in the treatment tank (not shown). Electrodes 56*a*–56*z* are inserted into alternating open spaces 55 to provide a series of successive work interface portions that extend along the web surfaces 58*a*–58*z* on one side of the continuous web. Each electrode 56*a*–56*z* includes a plurality of notches extending across the electrode surface adjacent web 34 and the notches are shaped to receive brackets 59. Brackets 59 fasten the conduit portions 13*a*–13*z* of each conduit 10*a*, 10*b*, or 10*c* to the electrode surface at a position whereby a portion of the slick outside wall surface 18 of each conduit portion 13*a*–13*z* is positioned against its respective work interface extending along web surfaces 58*a*–58*z*. As heretofore described and shown as 17 in FIG. 4, apertures are located adjacent the treatment interface on the downstream side of the conduit portions, and fresh electrolyte 38 is discharged from apertures 17 via the conduit attached to the electrolyte solution supply (not shown). Each electrode 56*a*–56*z* includes a conduit bumper 10*a*, 10*b*, or 10*c* extending along its first electrode side 60 and a conduit 10*a*, 10*b*, or 10*c* extending along its second electrode side 61 opposite the first electrode side. This conduit arrangement provides means for removing the composite barrier layer that forms along the treatment interface at the web surfaces. By way of illustration, electrode 56*b* has a first electrode side 60 adjacent the treatment interface along web surface 58*a* and a second electrode side 61 adjacent the treatment interface along web surface 58*b*. As web 34 slides across the slick outside surface of each conduit portion 13*a*–13*z* fastened to the electrode surfaces 60 and 61, the composite barrier layer is continuously wiped from treatment interface portions along respective web surfaces 58*a* and 58*b* while the conduit portions 13*a*–13*z* simultaneously deliver fresh electrolyte to the respective treatment interface via the electrolyte solution supply (not shown). This process of wiping away the composite barrier layer and replenishing electrolyte is repeated at each electrode 56*a*–56*z* along the looped pass-line of the continuous web 34 moving through the electrolyte solution 38. A regulated drain is provided to maintain a constant electrolyte solution level within the treatment tank. It should be understood that the conduit arrangement shown in FIG. 12 may be used in combination with bumper strips 21*a* or 21*b* as heretofore disclosed, without departing from the scope of this invention.

Figure 13:
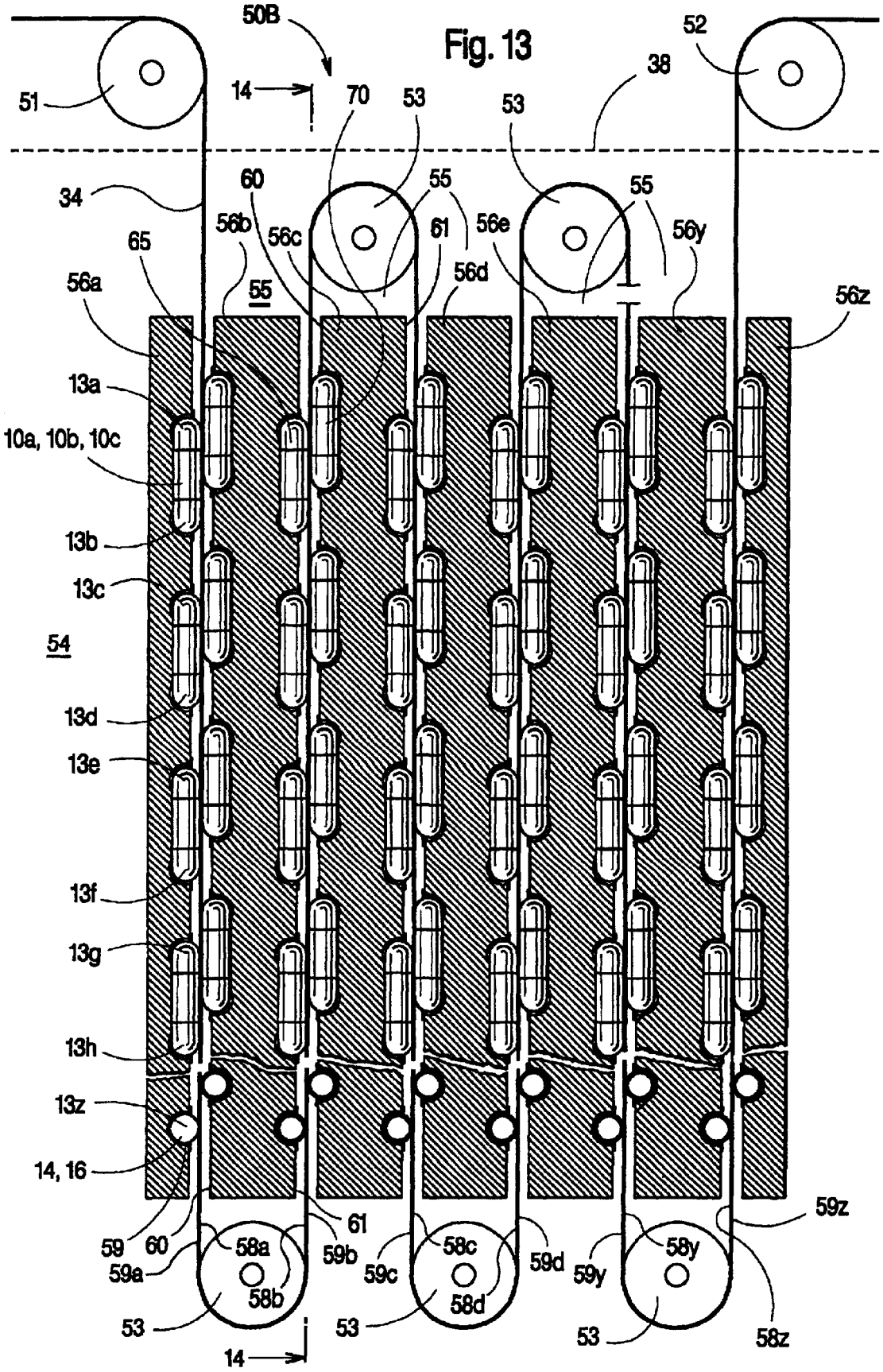
FIG. 13. is a schematic diagram showing a vertical electrochemical treatment line for treating two sides of a continuous web, the treatment line using conduit bumper devices for maintaining the continuous web in a pass-line through an electrolytic solution.

FIG. 13 shows a second vertical electrochemical treatment system 50B for treating two sides of a continuous web 34 moving through an electrolyte solution 38. System 50B comprises an entry roll 51 that may be a contact roll, an exit roll 52 that may be a contact roll, and looper rolls immersed in the electrolyte solution 38. The continuous web 34 runs through the electrolyte solution in a series of up and down passes as it follows the looper roll arrangement in the treatment tank (not shown). Electrode 56*a* is positioned adjacent a first work interface 59*a* along a first surface of continuous web 34, and electrode 56*z* is positioned adjacent a last work interface 59*z* along the first surface of the continuous web. The remaining electrodes 56*b*–56*y* are position within loop openings 55 created by the web pass-line along looper rolls 53. For example, electrode 56*b* is positioned within opening 55 between work interface 58*a* and work interface 58*b* extending along a second surface of the continuous web 34, electrode 56*c* is positioned within opening 55 between work interface surfaces 59*b* and 59*c*, and so on. Any one of the electrodes 56*a*–56*z* may be inserted or removed from the openings 55 to apply different electrochemical treatment results to opposite first and second surfaces of the continuous web 34.

Each electrode 56*a*–56*z* includes a plurality of notches extending across the electrode surface adjacent web 34, and the notches are shaped to receive brackets 59. Brackets 59 fasten the conduit portions 13*a*–13*z* of conduit 10*a*, 10*b*, or

10*c* to the electrode surface at a position that places the slick outside surface of each conduit portion 13*a*–13*z* against its corresponding work interface surface 58*a*–58*z* or 59*a*–59*z*. As heretofore described and shown in FIG. 4, apertures 17 are located adjacent the treatment interface on the downstream side of the conduit portions, and fresh electrolyte 38 is delivered to the conduit 10*a*, 10*b*, or 10*c* through line 41 attached to an electrolyte supply.

Each electrode includes a conduit bumper 10*a*, 10*b*, or 10*c* extending along its first electrode side 60 and a conduit bumper 10*a*, 10*b*, or 10*c* extending along its second electrode side 61 opposite the first electrode side as shown at electrodes 56*b* and 56*c*. This conduit arrangement provides means for removing the composite barrier layer that forms along the treatment interface. By way of illustration electrode 56*b* has a first electrode side 60 adjacent the treatment interface of web surface 58*a* and a second electrode side 61 adjacent treatment interface of web surface 58*b*. As web 34 slides across the slick outside surface of each conduit portion 13*a*–13*z* fastened to the electrode surfaces 60 and 61, the composite barrier layer is continuously wiped from the treatment interface portions along respective web surfaces 58*a* and 58*b* while the conduit portions 13*a*–13*z* simultaneously deliver fresh electrolyte to the respective treatment interface via the electrolyte solution supply (not shown). This process of wiping away the composite barrier layer and replenishing electrolyte is repeated at each electrode 56*a*–56*z* along the looped pass-line of the continuous web 34 moving through the electrolyte solution 38. A regulated drain (not shown) is provided to maintain a constant electrolyte solution level within the treatment tank. It should be understood that the conduit arrangement shown in FIG. 12 may be used in combination with bumper strips 21*a* or 21*b* as heretofore disclosed, without departing from the scope of this invention.

Figure 14:
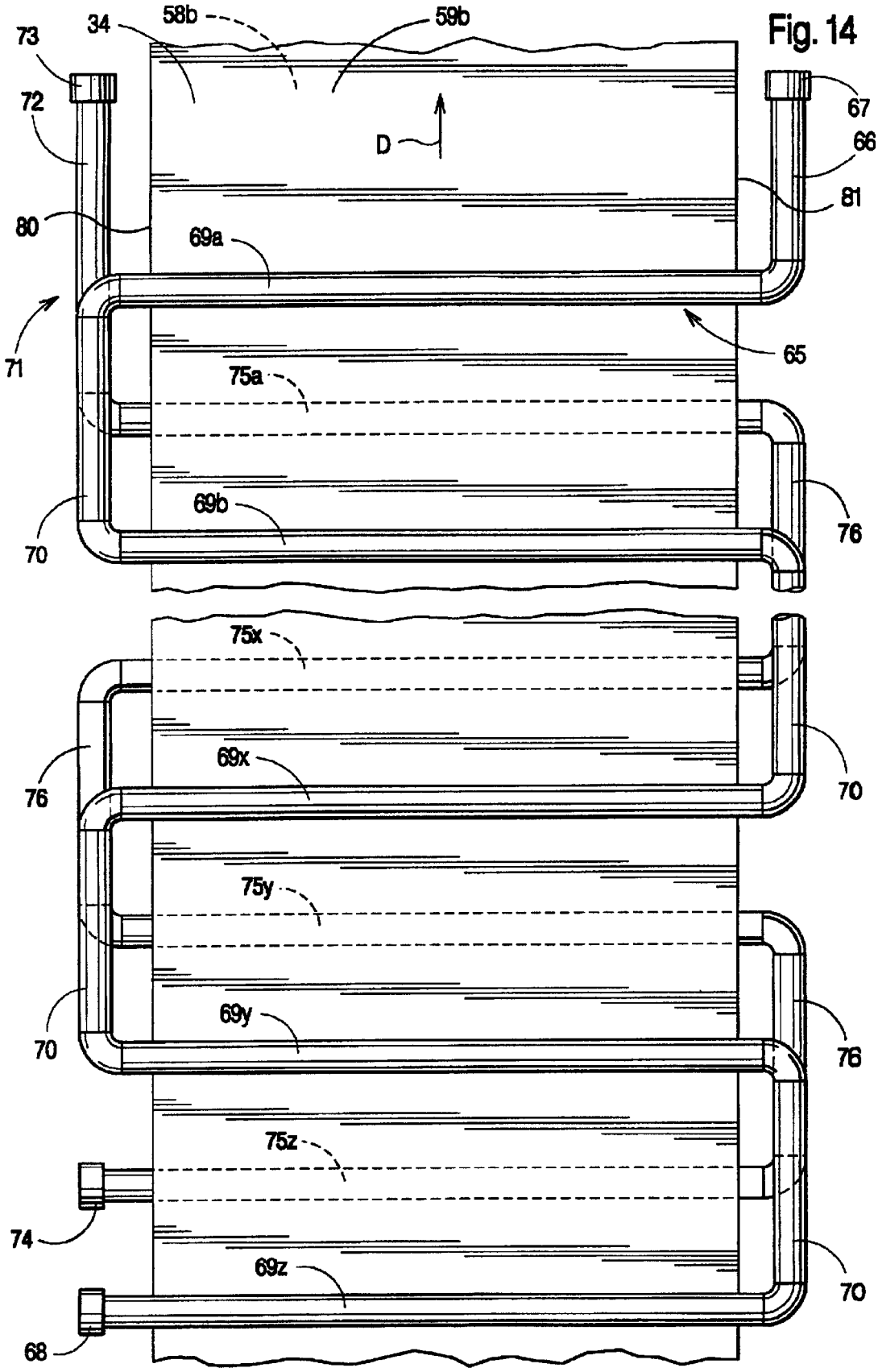
FIG. 14. is a schematic diagram taken along the lines 14—14 of FIG. 13 showing an offset conduit arrangement to prevent the pinching and possible binding of a continuous web between conduit bumper devices.

FIG. 14 taken along the lines 14—14 of FIG. 13 shows an exemplary arrangement for conduits 65 and 71 attached to adjacent electrodes 56*b* and 56*c* shown in FIG. 13. The conduits 65 and 70 are off-set with respect to each other at locations along the length of the web surfaces 58*b* and 59*b* to prevent binding or pinching the continuous web 34 between the spaced apart conduit portions 13*a*–13*z* positioned along surfaces 58*b* and 59*b* of web 34, FIG. 13. Various conduit arrangements may be used to prevent pinching the continuous web without departing from the scope of this invention, however, in this example, conduit bumper 65 includes a feed line 66 having a connection end 67 for attachment to a fresh electrolyte supply (not shown), a capped end 68 opposite connection end 67 and a plurality of conduit portions 69*a*–69*z* that are spaced apart along the length of the continuous web 34 by return sections 70 that extend between adjacent conduit portions 69*a*–69*z*. As shown in FIG. 14, conduit portions 69*a*–69*z* extend across the surface 61 of electrode 56*b* and are attached thereto by brackets as heretofore described. Return sections 70 are positioned outboard from the continuous web edges 80 and 81 and extend between adjacent conduit portions 69*a*–69*z* in an alternating pattern along opposite sides of the continuous web 34 to provide a continuous serpentine conduit extending along a length of the treatment interface along web surface 58*b* with the spaced apart conduit portions extending across the width and contacting the treatment interface along the web surface. The connecting return sections 70 are outboard from the web edges 80 and 81 and therefore do not contact the web surface.

In a similar manner, conduit bumper 71 includes a feed line 72 having a connection end 73 for attachment to the fresh electrolyte supply, a capped end 74 opposite connection end 73, and a plurality of conduit portions 75*a*–75*z* that are spaced apart by return sections 76 extending between adjacent conduit portions 75*a*–75*z*. Conduit portions 75*a*–75*z* extend across the first side 60 of electrode 56*c* (FIG. 13) and are attached thereto by brackets as heretofore disclosed, or by any other suitable fastening means known in the art. Return sections 76 are positioned outboard from the continuous web edges 80 and 81 and extend between adjacent conduit portions 75*a*–75*z* in an alternating pattern, along the web side opposite conduit 65, to provide a continuous serpentine conduit along a length of web surface 59*b* with the spaced apart conduit portions 75*a*–75*z* extending across the width and contacting the web surface 59*b*. The connecting return sections 76 are outboard from the web edges and therefore not contacting the treatment interface at the web surface. Conduit 71 is located adjacent the continuous web surface opposite conduit bumper 65, and is offset so that the conduit portions 75*a*–75*z* do not lineup with respective conduit portions 69*a*–69*z* on the opposite side of web 34. By positioning the conduit portions 65 and 70 in such a staggered or off-set spaced apart arrangement along opposite sides of continuous web 34, the continuous web will not be pinched or squeezed between the conduit portions as the continuous web travels at high speed through the electrolyte solution contained in the electrochemical treatment tank.

Figure 15:
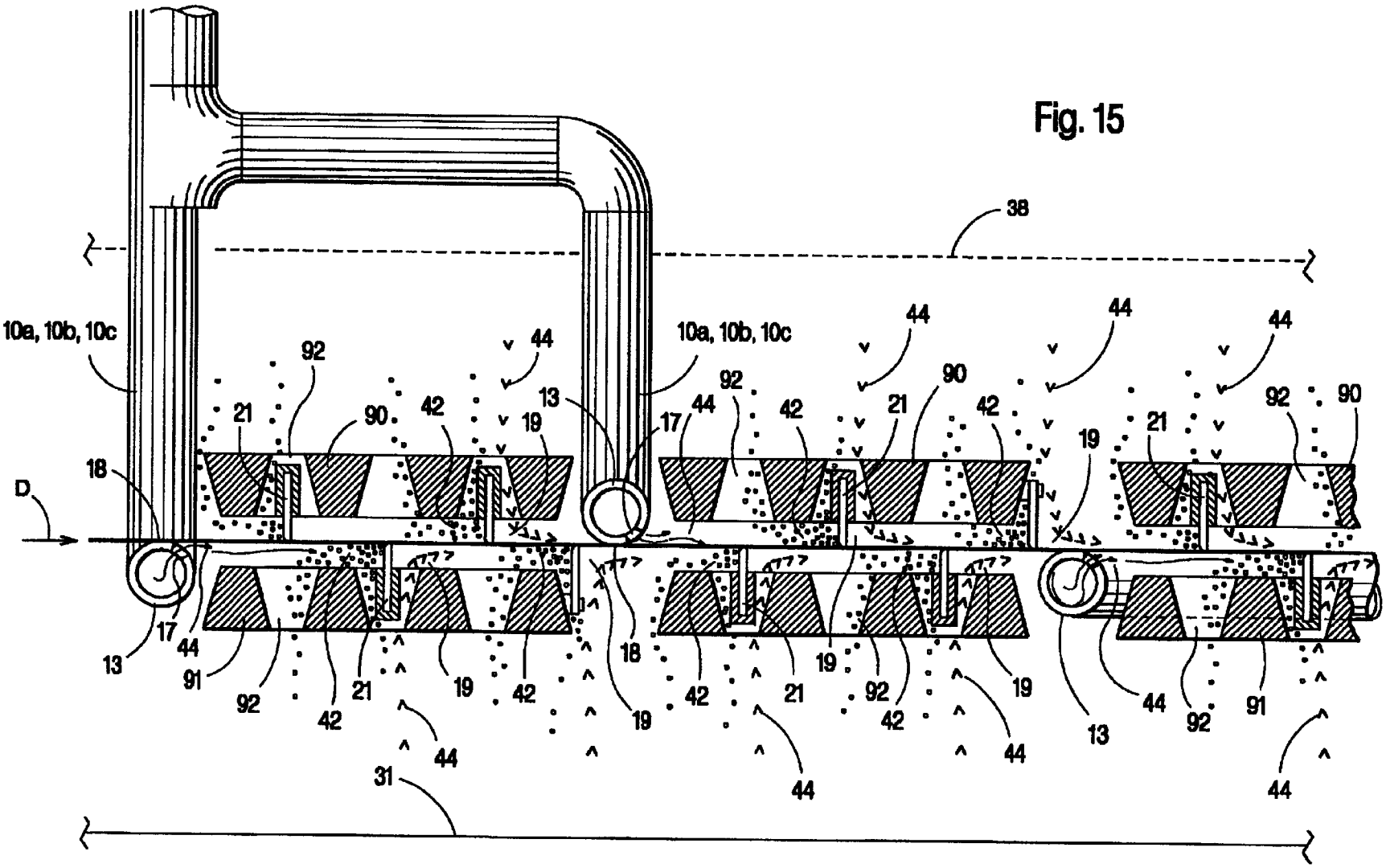
FIG. 15. is an enlarged cross-section similar to FIG. 9 showing perforated electrodes used in an electrochemical treatment operation.

The drawing figures show generic electrodes for the purpose of illustrating that the present invention is not limited to a particular electrode design. However, it is recognized that in certain instances perforated electrodes, for example as disclosed in U.S. Pat. No. 5,476,578, are a preferred electrode design to facilitate a forced hydraulic flow of fresh electrolyte to the electrochemical treatment interface. Referring to FIG. 15 of the drawings, a continuous electrochemical treatment line similar to FIG. 9 is shown comprising a plurality of perforated electrodes 90 and 91 spaced apart along opposite sides of a continuous substrate immersed in an electrolytic bath 38 contained in a treatment tank 31. As heretofore disclosed, conduits 10*a*, 10*b*, and/or 10*c* deliver fresh electrolyte to the treatment interface at various locations along either one or both sides of the substrate. The conduit portions 13 extend across and engage the surface of the substrate with their slick surface portion 18 as described above, and the contact dislodges the composite barrier 42 along the upstream side of the conduit portions 13 as the continuous web moves at high speed in the direction shown by arrow "D". This creates a partial vacuum on the downstream side 19 of each conduit portion 13 that is filled with fresh electrolyte 44 delivered from the conduit apertures 17. In a similar manner, each bumper strip 21 extends across and engages the surfaces of the substrate with its slick surface 23 as described above and dislodges the composite barrier 42 along the upstream side of the strip. This creates a partial vacuum 19 on the downstream side of each bumper strip 21. The pressure differential between the electrolyte bath 38 and the partial vacuum portions 19 creates a forced hydraulic flow of fresh electrolyte 44 from the electrolyte bath 38, through the apertures or perforations 92 in the electrodes 90 and 91, and into the partial vacuum portions 19. This forced hydraulic flow delivers a continuous supply of fresh electrolyte to the electrochemical treatment interface.

As heretofore mentioned, use of the improved rigid, ultra high molecular weight polymer bumper devices at a continuous electroplating operation located in San Paulo, Brazil has resulted in improved plating speed by about a 20% or more increase in the deposition rate. However, it should be understood that use of the rigid, ultra high molecular weight polymer bumper devices of the present invention is not limited to electroplating operations as demonstrated by the following examples.

EXAMPLE 1

Electroplating

Referring to exemplary FIG. 7, bumper strips 21*a* or 21*b* extend outward from electrode(s) or soluble anode(s) 36*a*–36*z* and 37*a*–37*z* having a positive charge, with the slick contact surfaces of the bumper strips (shown at 23 in FIGS. 5 and 6) positioned along pass-line "X" and contacting the continuous web or cathode 34 having a negative charge, delivered by an energy source. The continuous web is moving at high speed through the electrolyte solution 38, the ions, contained within tank 31 in a continuous electroplating line. In an electroplating operation, the higher metal, the anodes(s) loses electrons and becomes ions in the electrolyte solution. The electrolyte solution completes the electrochemical circuit to carry the current (electrons) from the anode(s) to the cathode where the metallic ions in solution pick up electrons and are electrochemically deposited onto the surface of the continuous web (the cathode) as an elemental metal coating. It should be understood that in such electroplating operations, the bumper strips 21*a* or 21*b* can be replaced by, or used in combination with, the conduit 10*a*, 10*b*, or 10*c* of the present invention.

EXAMPLE 2

Anodizing

Referring again to exemplary FIG. 7, bumper strips 21*a* or 21*b* extend outward from negatively charged electrodes 36*a*–36*z* and 37*a*–37*z*, the cathode(s) with the slick bumper strip contact surfaces 23 positioned along pass-line "X" and in contact with continuous web 34 (anode) that has received a positive charged from an energy source, the web moving at high speed through electrolyte solution 38 (the ions) contained within tank 31 in a continuous anodizing line. In anodizing, the transformation, or oxidation, of the metallic anode surface to an oxide forms an anodized coating on surface of continuous web 34. It should be understood that in such anodizing operations, the bumper strips 21*a* or 21*b* can be replaced by, or used in combination with, the conduit 10*a*, 10*b*, or 10*c* of the present invention.

EXAMPLE 3

Bipolar Cleaning

Referring again to the exemplary FIG. 7, bumper strips 21*a* or 21*b* extend outward from electrodes 36*a*–36*z* and electrodes 37*a*–37*z* with the slick bumper strip contact surfaces 23 positioned along pass-line "X" and in contact with continuous web 34 moving at high speed through a soap solution 38 (Sodium Hydroxide or the like) contained within a tank 30 in a continuous electrochemical cleaning line. The electrodes are arranged in alternating pairs of positive and negative electrodes that are spaced apart along the length of pass-line "X". For example, in FIG. 7, the first pair of electrodes 36*a* and 37*a* have a positive charge, the second pair of electrodes 36*b* and 37*b* have a negative charge, the third pair of electrodes 36*c* and 37*c* have a positive charge and so on. In such electrochemical cleaning operations, the continuous web has a negative electrical charge when the cleaning apparatus is installed in an electroplating line and a positive electrical charge when the apparatus is installed in an anodizing line, as heretofore mentioned above in Examples 1 and 2. Following a selected single portion of the continuous web as it moves along pass-line "X" between alternating pairs of positive and negative charged electrodes in an anodizing line where the continuous web has a positive charge, when the selected web portion passes between positive charged electrodes, for example 36*a* and 37*a*, the web portion dirt is loosened or released from the web, and when the selected web portion passes between negative charged electrodes, for example 36*b* and 37*b*, the released dirt is driven from the web surface toward the negative charged pair of electrodes. Similarly, in an electroplating line, where the continuous web has a negative charge, when the selected web portion passes between positive charged electrodes dirt is driven from the web surface toward the positive electrodes, and when the selected web portion passes between negative charged electrodes dirt is loosened or released from the web surface. Such electrochemical cleaning operations are accompanied by a strong agitation of the soap solution which prevents the released dirt from contacting and coating the electrodes, the agitation causing the dirt to float to the bath surface where it is either skimmed off or filtered off via a drain system. The last pair of electrodes 36*z* and 37*z* will have either a positive or a negative charge, depending upon the electrochemical treatment process, to provide one last cleansing action that further drives any remaining dirt from the web just before the web exits the soap solution 38. It should be understood that in such cleaning operations, the bumper strips 21*a* or 21*b* can be replaced by, or used in combination with, the conduit 10*a*, 10*b*, or 10*c* of the present invention.

EXAMPLE 4

Bipolar Pickling

Referring again to the exemplary FIG. 7, bumper strips 21*a* or 21*b* extend outward from electrodes 36*a*–36*z* and electrodes 37*a*–37*z* with the slick bumper strip contact surfaces 23 positioned along pass-line "X" and in contact with continuous web 34 moving at high speed through a pickle liquor 38 (Hydrochloric acid, sulfuric acid, or the like) contained within tank 31 in a continuous electrochemical pickling line. On the entry side of tank 31, when the tank is installed in an electroplating line, the electrodes, for example electrodes 36*a* to about 36*e* or higher and electrodes 37*a* to about 37*e* or higher have a negative charge, and the continuous web has a positive charge so that dirt is loosened or released from the web. On the exit end of tank 31, the electrodes, for example electrodes starting at about 36*v* to 36*z* and electrodes starting at about 37*v* to 37*z*, have a positive charge so that the loosened dirt is driven toward the positive charged electrodes. When tank 31 is installed in an anodizing line, polarity is reversed so that electrodes 36*a*–36*e* and electrodes 37*a*–37*e* have a positive charge, and electrodes 36*v*–36*z* and electrodes 37*v*–37*z* have a negative charge. It should be understood that in such pickling operations, the bumper strips 21*a* or 21*b* can be replaced by, or used in combination with, the conduit 10*a*, 10*b*, or 10*c* of the present invention.

It should be understood the although Examples 1–4 disclose electrochemical process for treating two sides of a continuous web, the apparatus may be adapted to electrochemically treat only one side of a continuous web without departing from the scope of this invention. And furthermore, while this invention has been described as having a preferred embodiment, it is understood that it is capable of further modifications, uses, and/or adaptations of the invention, following the general principle of the invention and including such departures from the present disclosure as have come within known or customary practice in the art to which the invention pertains, and as may be applied to the central features hereinbefore set forth, and fall within the scope of the invention of the limits of the appended claims. For example, the exemplary electrodes 36*a*–36*z* and 37*a*–37*z* shown in FIGS. 7–11, may comprise anode basket arrangements similar to the basket arrangements disclosed in U.S. Pat. No. 5,938,899, and it should be understood that such anode baskets may be manufactured using either conductive or non-conductive material. It should also be understood that this invention is not limited to any particular electrode configuration and can comprise any suitable electrode arrangement, for example, the electrodes shown in U.S. Pat. No. 4,476,578, without departing from the scope of this invention. Additionally, even though the bumper devices of the present invention are shown comprising elongated strips and conduits, such bumper devices may be manufactured to any suitable shape, for example a chevron shape as shown in FIG. 14 or a honeycomb shape shown in FIG. 37 of U.S. Pat. No. 4,476,578, without departing from the scope of this invention.

I claim:

1. A process for electrochemically treating a continuous web moving through an electrolyte solution contained in a treating line tank the steps of the process comprising:

providing at least one electrode positioned adjacent at least one surface of the continuous web moving through the electrolyte solution, said at least one electrode extending across a width of the continuous web;

providing at least one rigid, non-flexible, and non-conductive bumper device extending across and contacting the entire width of said at least one surface of the continuous web moving through the electrolyte solution;

maintaining said continuous web in a pass-line position through the electrolyte solution by positioning said at least one bumper device against the entire width of said at least one surface of the continuous web; and causing said least one surface of the continuous web to slide against a surface of said at least one bumper device, said continuous web moving along said pass-line position through the electrolyte solution so that said least one surface of the continuous web is electrochemically treated.

2. The process recited in claim 1 further comprising:

providing at least two said bumper devices, each bumper device comprising a rigid, non-flexible, and non-conductive elongated strip that extends across and contacts the entire width of the continuous web maintained in said pass-line position through the electrolyte solution, each said elongated strip having an attachment end fastened to said at least one electrode, each said elongated strip having a contact surface opposite said attachment end;

removing a composite barrier formed at a treatment interface along said at least one surface of the continuous web by sliding said at least one surface of the continuous web against said contact surface as the continuous web moves through the electrolyte solution; and introducing fresh electrolyte at said treatment interface along said at least one surface of the continuous web.

3. The process recited in claim 2 further comprising:

providing at least one electrode positioned adjacent a second surface of the continuous web moving through the electrolyte solution;

providing at least two said bumper devices comprising elongated strips having attachment ends fastened to said at least one electrode adjacent the continuous web second surface and having a contact surface positioned to contact the entire width of said second surface;

removing a composite barrier formed at a treatment interface along said web second surface, said composite barrier removed by sliding the entire width of said continuous web second surface against each said bumper device contact surface as the continuous web moves through the electrolyte solution; and introducing fresh electrolyte at said treatment interface along said second surface of the continuous web.

4. The process recited in claim 3 further comprising:

introducing said fresh electrolyte at said treatment interface by a forced hydraulic action produced by the continuous web sliding against said contact surface of said bumper devices.

5. The process recited in claim 4 including the further step comprising:

introducing said fresh electrolyte at said treatment interface through a conduit attached to an electrolyte feed stream having a positive pressure.

6. The process recited in claim 1 wherein:

said at least one bumper device is a conduit.

7. The process recited in claim 6 further comprising:

providing at least one electrode positioned adjacent a second surface of the continuous web;

providing at least one said bumper device comprising a conduit, wherein said at least one bumper device extends across and contacts the entire width of said second surface;

maintaining said continuous web in said pass-line position through the electrolyte solution by positioning said at least one bumper device against the entire width of said second surface; and causing said second surface of the continuous web to slide against a surface of said at least one bumper device, said continuous web moving along said pass-line position through the electrolyte solution so that ions contained in the electrolyte solution electrochemically treat said second surface of the continuous web.

8. The process recited in claim 7 further comprising:

attaching an inlet end of said at least one conduit to an electrolyte solution feed stream;

extending at least one portion of said conduit across the width of the continuous web so that an outside surface portion of said conduit is positioned against said second surface of the continuous web moving in said pass-line position through the electrolyte solution;

providing apertures spaced apart along a length of said at least one conduit portion, said apertures extending through a wall portion of said conduit portion at a location proximate said second surface of the continuous web;

removing a composite barrier formed at a treatment interface along said second surface by sliding said second surface of the continuous web across said outside surface portion of said conduit proximate said spaced apart apertures as the continuous web moves through the electrolyte solution to; and discharging said electrolyte solution feed stream through said spaced apart apertures to introduce fresh electrolyte at said treatment interface along said second surface of the continuous web.

9. The process recited in claim 6 further comprising:

attaching an inlet end of said conduit to an electrolyte solution feed stream;

extending at least one conduit portion across the width of the continuous web so that an outside surface portion of said conduit is positioned against said at least one surface of the continuous web moving in said pass-line position through the electrolyte solution;

providing apertures spaced apart along a length of said at least one conduit portion, said apertures extending through a wall of said at least one conduit portion at a location proximate said at least one surface of the continuous web;

removing a composite barrier formed at a treatment interface along said at least one surface by sliding said at least one surface of the continuous web across said outside surface portion of said conduit proximate said spaced apart apertures as the continuous web moves through the electrolyte solution; and discharging the electrolyte solution feed stream through said spaced apart apertures to introduce fresh electrolyte at said treatment interface along said at least one surface of the continuous web.

10. The process recited in claim 6 wherein said conduit is a serpentine shaped conduit comprising a plurality of spaced apart conduit portions extending across the width of said at least one surface of the continuous web, the steps of the process further comprising:

attaching an inlet end of said serpentine shaped conduit to an electrolyte solution feed stream;

positioning an outside surface portion of each of the said spaced apart conduit portions against said at least one surface of the continuous web moving through the electrolyte solution;

providing apertures spaced apart along a length at each said outside surface portion, said apertures extending through a wall of the said spaced apart conduit portions at a location proximate said at least one surface of the continuous web;

removing a composite barrier formed at a treatment interface, said composite barrier removed by sliding said at least one surface of the continuous web against said outside surface portions proximate said spaced apart apertures as the continuous web moves through the electrolyte solution; and discharging said electrolyte solution feed stream through said spaced apart apertures to introduce fresh electrolyte at said treatment interface along said at least one surface of the continuous web.

11. The process recited in claim 10 further comprising:

introducing fresh electrolyte at said treatment interface by a forced hydraulic action generated by the continuous web sliding against said surface portion, said forced hydraulic action causing electrolyte solution from said feed stream to flow outward from said spaced apart apertures extending through said wall portion of each of the said conduit portions.

12. The process recited in claim 10 further comprising:

applying a positive pressure to said electrolyte feed stream to cause the electrolyte solution to flow outward from said apertures extending through said wall portion of each of the said conduit portions.

13. The process recited in claim 1 wherein said at least one rigid, non-flexible, and non-conductive bumper device is manufactured from a material having a relative coefficient of sliding friction to rolled steel of about 0.15 or lower.

14. The process recited in claim 13 wherein said at least one bumper device is manufactured from a plastic material.

15. The process recited in claim 13 wherein said at least one bumper device is manufactured from an ultra high molecular weight polymer.

16. The process recited in claim 15 wherein said ultra high molecular weight polymer material is non-polar.

17. The process recited in claim 15 wherein said ultra high molecular weight polymer material is polyethylene.

18. The process recited in claim 1 wherein said at least one electrode is positive and comprises soluble anodes, said continuous web is negative, and said electrochemical treatment deposits an electroplated coating on the continuous web.

19. The process recited in claim 1 wherein said at least one electrode is positive and comprises insoluble anodes, said continuous web is negative, and said electrochemical treatment deposits an electroplated coating on the continuous web.

20. The process recited in claim 1 wherein said at least one electrode is negative, said continuous web is positive, and said electrochemical treatment anodizes the continuous web.

21. The process recited in claim 1 further comprising:

providing at least one treating line tank containing a cleaning solution;

providing a bipolar electrochemical cleaning apparatus in said tank containing the cleaning solution, said bipolar electrochemical cleaning apparatus comprising alternating pairs of positive and negative electrodes positioned along opposite sides of a pass-line extending through said cleaning solution;

providing at least one rigid, non-flexible and non-conductive bumper device extending across the entire width of said at least one surface of the continuous web moving through the cleaning solution;

maintaining said continuous web in a pass-line position through the cleaning solution by positioning said at least one bumper device against said entire width of said at least one surface of the continuous web; and causing the continuous web to move along said pass-line between said alternating pairs of positive and negative electrodes, whereby said alternating pairs of positive and negative electrodes drive dirt from said continuous web.

22. The process recited in claim 21 wherein said alternating pairs of positive and negative electrodes are insoluble electrodes.

23. The process recited in claim 21 wherein said alternating pairs of positive and negative electrodes are soluble electrodes.

24. The process recited in claim 21 wherein a last pair of said alternating pairs of electrodes, located adjacent a discharge end of said treating line tank, has a negative charge.

25. The process recited in claim 21 wherein said cleaning solution is a soap solution.

26. The process recited in claim 21 wherein said cleaning solution is a pickle liquor solution.

27. The process recited in claim 1 further comprising:

providing at least one treating line tank containing a cleaning solution;

providing a bipolar electrochemical cleaning apparatus in said tank containing the cleaning solution, said bipolar electrochemical cleaning apparatus comprising a plurality of positive electrodes arranged in pairs along opposite sides of a pass-line extending through said cleaning solution, and a plurality of negative electrodes arranged in pairs along opposite sides of said pass-line;

providing at least one rigid, non-flexible and non-conductive bumper device extending across the entire width of said at least one surface of the continuous web moving through the cleaning solution;

maintaining said continuous web in a pass-line position through the cleaning solution by positioning said at least one bumper device against said entire width of said at least one surface of the continuous web; and causing the continuous web to move along said pass-line between said pairs of positive and between said pairs of negative electrodes, wherein said pairs of positive and negative electrodes drive dirt from said continuous web.

28. The process recited in claim 27 wherein said positive and negative electrodes are soluble electrodes.

29. The process recited in claim 27 wherein said pairs of positive and negative electrodes are soluble electrodes.

30. The process recited in claim 27 wherein said cleaning solution is a soap solution.

31. The process recited in claim 27 wherein said cleaning solution is a pickle liquor solution.

* * * * *